US010632741B2

(12) United States Patent
Tamura et al.

(10) Patent No.: US 10,632,741 B2
(45) Date of Patent: Apr. 28, 2020

(54) PRINT ELEMENT SUBSTRATE, METHOD OF MANUFACTURING PRINT ELEMENT SUBSTRATE, AND METHOD OF MANUFACTURING PRINTHEAD

(71) Applicant: CANON KABUSHIKI KAISHA, Tokyo (JP)

(72) Inventors: Hideo Tamura, Kawasaki (JP); Takaaki Yamaguchi, Yokohama (JP); Yohei Osuki, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/009,808

(22) Filed: Jun. 15, 2018

(65) Prior Publication Data

US 2019/0001663 A1 Jan. 3, 2019

(30) Foreign Application Priority Data

Jun. 29, 2017 (JP) ..... 2017-127830
May 1, 2018 (JP) ..... 2018-088406

(51) Int. Cl.
*B41J 2/045* (2006.01)
*B41J 2/16* (2006.01)
*B41J 2/14* (2006.01)

(52) U.S. Cl.
CPC ..... *B41J 2/0451* (2013.01); *B41J 2/0458* (2013.01); *B41J 2/04565* (2013.01); *B41J 2/1412* (2013.01); *B41J 2/14129* (2013.01); *B41J 2/14153* (2013.01); *B41J 2/1601* (2013.01); *B41J 2/1626* (2013.01); *B41J 2202/18* (2013.01); *B41J 2202/20* (2013.01); *B41J 2202/21* (2013.01)

(58) Field of Classification Search
CPC .. B41J 2/04565; B41J 2/14129; B41J 2/1412; B41J 2/0458; B41J 2/1601; B41J 2202/21; B41J 2202/18; B41J 2/14088; B41J 2/14112
See application file for complete search history.

(56) References Cited

U.S. PATENT DOCUMENTS 8,439,477 B2 5/2013 Markham et al.

OTHER PUBLICATIONS

IP.com search (Year: 2019).*

* cited by examiner

*Primary Examiner* — Lisa Solomon
(74) *Attorney, Agent, or Firm* — Venable LLP

(57) ABSTRACT

A print element substrate comprises: a plurality of heaters configured to cause discharge of droplets; a pad array in which a plurality of pads configured to do electrical connection from an outside are arranged; and a plurality of resistance monitor elements configured to measure resistance values of the plurality of heaters, wherein the plurality of resistance monitor elements are arranged along a direction of the pad array.

19 Claims, 11 Drawing Sheets

MEASURED
RESISTANCE VALUE:R4
SHEET RESISTANCE:ρs

MEASURED
RESISTANCE VALUE:R5
SHEET RESISTANCE:ρs

MEASURED
RESISTANCE VALUE:R6
SHEET RESISTANCE:ρs

PRINT ELEMENT SUBSTRATE, METHOD OF MANUFACTURING PRINT ELEMENT SUBSTRATE, AND METHOD OF MANUFACTURING PRINTHEAD

BACKGROUND OF THE INVENTION

Field of the Invention

The present invention relates to a print element substrate, a method of manufacturing a print element substrate, and a method of manufacturing a printhead.

Description of the Related Art

Conventionally, concerning an inkjet printing apparatus, there is known an apparatus that heats a liquid by an electrothermal transducer including a heater as an energy generation element configured to generate energy used to discharge ink from an orifice of a printhead.

In recent years, to implement printing of a high-definition image at a higher speed, implementation of a printhead with a larger print width is demanded. More specifically, a printhead having a length of 4 inches to 12 inches is also required. An arrangement is known in which a plurality of print element substrates with nozzles, each of which includes an appropriate number of nozzles and has an appropriate length, are arranged on a plate, thereby implementing a printhead having a large print width as a whole. However, following problems arise in a printhead having such an arrangement.

Since dimensional variations derived from a manufacturing process are generated between the plurality of print element substrates, the discharge amount changes a little between the print element substrates. In a case in which such print element substrates are arranged at random, as for the relationship between the print element substrates and droplet discharge amounts, even if the print element substrates are driven by the same signal, the density change may be uneven. When printing is performed using a printhead in which such print element substrates are arranged, even a small discharge amount difference between the print element substrates causes density unevenness, resulting in difficulty in performing high-quality printing. In particular, if the discharge amount difference is large between adjacent print element substrates, the density unevenness is very noticeable.

The discharge amount of droplets is associated with the size of the diameter of an orifice to discharge the droplets or the area of a heater that is energy for discharge. For example, U.S. Pat. No. 8,439,477 discloses a method of electrically measuring the size of a heater.

However, the technique of U.S. Pat. No. 8,439,477 uses an arrangement in which test resistors are arranged along a direction that is parallel to the arrangement array of heaters configured to cause discharge of droplets and orthogonal to a pad array. According to this arrangement, the distance between a test resistor and a pad that is an input/output of an electrical signal or the like from the outside increases, or the distance from the pad changes between the plurality of test resistors. For this reason, the variation in the wiring resistance from the pad to the test resistor is included in the variation in the resistance value, and a deviation occurs in a heater size calculated from the resistance value. In particular, if the sheet resistance values of the heater and the test resistor are low, the influence of the variation in the wiring resistance becomes large.

SUMMARY OF THE INVENTION

According to one aspect of the present invention, there is provided a print element substrate comprising: a plurality of heaters configured to cause discharge of droplets; a pad array in which a plurality of pads configured to do electrical connection from an outside are arranged; and a plurality of resistance monitor elements configured to measure resistance values of the plurality of heaters, wherein the plurality of resistance monitor elements are arranged along a direction of the pad array.

According to another aspect of the present invention, there is provided a method of manufacturing a print element substrate including: a plurality of heaters configured to cause discharge of droplets; a pad array in which a plurality of pads configured to do electrical connection from an outside are arranged; and a plurality of resistance monitor elements configured to measure resistance values of the plurality of heaters, the method comprising forming the plurality of heaters and the plurality of resistance monitor elements using the same material, wherein the plurality of resistance monitor elements are arranged along a direction of the pad array.

According to another aspect of the present invention, there is provided a method of manufacturing a printhead including a plurality of print element substrates, comprising: forming, on one wafer, a plurality of print element substrates each including a plurality of heaters configured to cause discharge of droplets, a pad array in which a plurality of pads configured to do electrical connection from an outside are arranged, and a plurality of resistance monitor elements configured to measure resistance values of the plurality of heaters, wherein the plurality of resistance monitor elements are arranged along a direction of the pad array; measuring a resistance value of each of the plurality of resistance monitor elements provided on each of the plurality of print element substrates; calculating sizes of the heaters provided on each of the plurality of print element substrates based on the measured resistance values; classifying the plurality of print element substrates based on the calculated sizes of the heaters; and embedding the plurality of print element substrates in one printhead based on the classification.

According to the present invention, it is possible to suppress a variation in the resistance values of wirings connected to the resistance monitor elements and suppress a deviation of heater sizes calculated from the resistance values. Accordingly, in the printhead in which the plurality of print element substrates are arranged, density unevenness between the print element substrates can be suppressed, and satisfactory printing can be performed.

Further features of the present invention will become apparent from the following description of exemplary embodiments (with reference to the attached drawings).

DESCRIPTION OF THE EMBODIMENTS

Figure 1A:
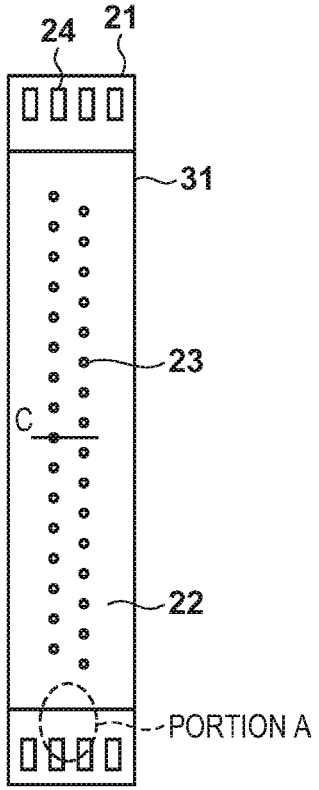
FIGS. 1A, 1B, and 1C are views showing an example of the arrangement of a print element substrate with nozzles according to the present invention.
Figure 1B:
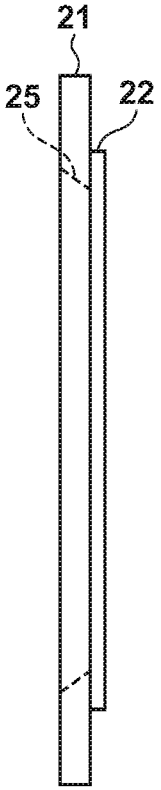
Figure 1C:
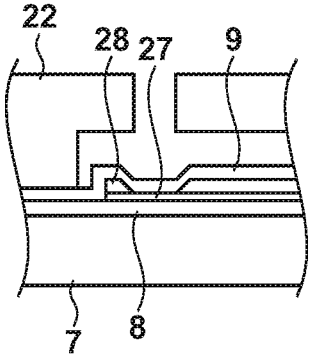

Embodiments of the present invention will be described with reference to the accompanying drawings. FIGS. 1A, 1B, and 1C are views showing an example of the arrangement of a print element substrate with nozzles according to the present invention. FIG. 1A is a plan view, FIG. 1B is a side view, and FIG. 1C shows a schematic section taken along a line C-C'. In a print element substrate 31 with nozzles, a through hole (ink supply port) 25 configured to supply ink from the back surface of the print element substrate is formed. A plurality of heaters 27 configured to apply discharge energy to the ink are arranged on the surface of a print element substrate 21 on both sides of the through hole 25. In addition, an orifice plate 22 is provided on the print element substrate 21, and a plurality of orifices 23 are formed in the orifice plate 22 so as to face the plurality of heaters 27, respectively. A plurality of electrode pads 24 electrically connected to the plurality of heaters 27 or the like are arranged at two ends of the surface of the print element substrate 21.

The schematic section taken along the line C-C' shown in FIG. 1C is obtained by cutting the center of the orifice 23. An insulating layer 8, the heater 27, and wiring electrodes 28 are stacked on a base 7 and patterned into shapes. A protective film 9 is stacked on them, and the orifice plate 22 is formed on the protective film 9.

Figure 2:
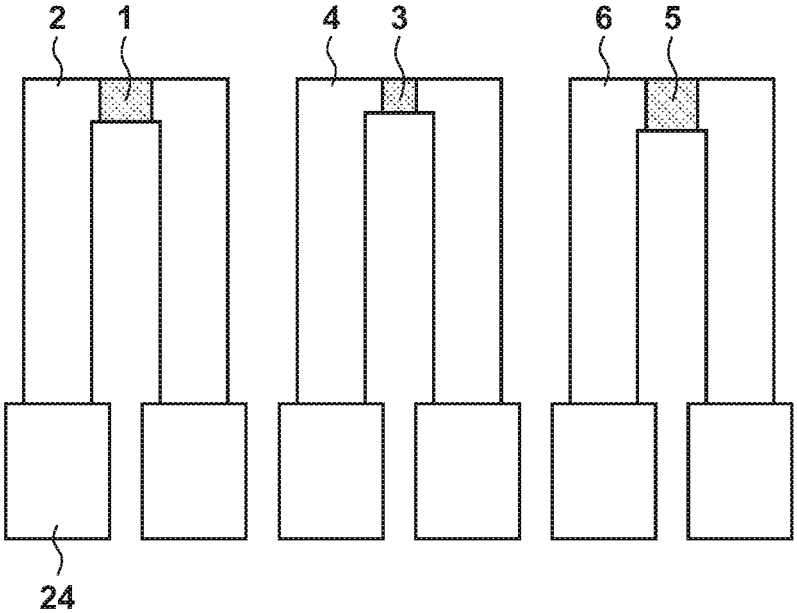
FIG. 2 is a view showing an example of the arrangement of resistance monitor elements according to the present invention.

Three resistance monitor elements according to the present invention are arranged in a portion A shown in FIG. 1A. FIG. 2 shows an example of the arrangement of the resistance monitor elements. The resistance monitor element is provided to measure the resistance value of a resistor formed on the print element substrate and formed by the same manufacturing method and material as the resistor. The three resistance monitor elements according to the present invention are arranged at positions close to each other and are also arranged at positions close to the electrode pads 24 arranged at the substrate ends. Here, the distance between the resistance monitor elements is defined in advance. For example, the distance may be defined based on the positional relationship between a resistance monitor element, a pad, and a heater or may be defined in accordance with a wiring resistance or a film thickness distribution to be described later with reference to FIGS. 12A, 12B, and 12C. Electrodes (wirings) 2, 4, and 6 used to measure resistors 1, 3, and 5 of the resistance monitor elements are electrically connected to the electrode pads 24 and configured such that the measurement can be performed from the outside. A description will be made here while defining the resistance monitor elements as a first resistance monitor element, a second resistance monitor element, and a third resistance monitor element sequentially from the left of FIG. 2.

Figure 3A:
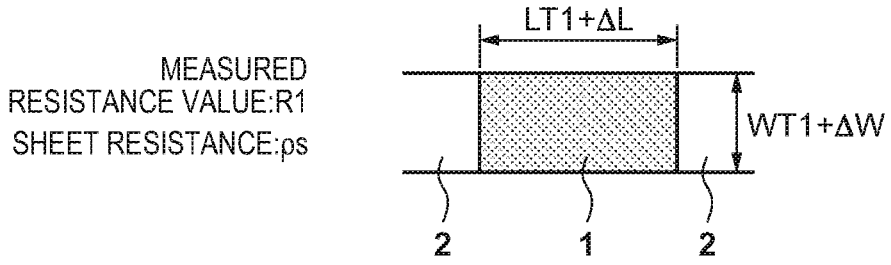
FIGS. 3A, 3B, 3C, and 3D are views showing details of the arrangements of the resistance monitor elements according to the present invention.
Figure 3B:
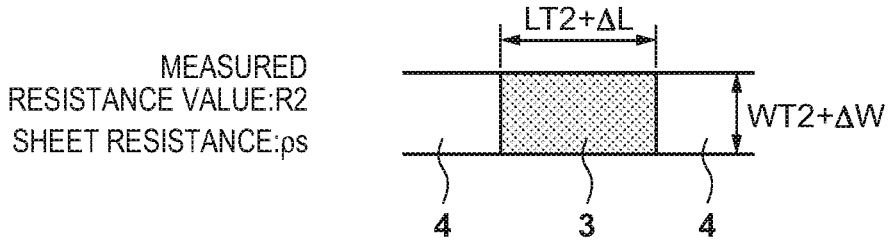
Figure 3C:
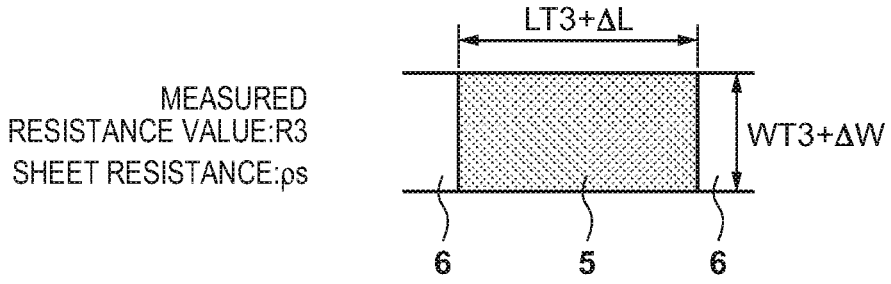

FIGS. 3A, 3B, 3C, and 3D are views showing details of the arrangements of the resistance monitor elements according to the present invention. FIG. 3A shows the first resistance monitor element, and shows the resistor 1 serving as the first resistance monitor element, and the electrodes 2 connected to this. FIG. 3B shows the resistor 3 serving as the second resistance monitor element, and the electrodes 4 connected to this. FIG. 3C shows the resistor 5 serving as the third resistance monitor element, and the electrodes 6 connected to this.

Figure 3D:
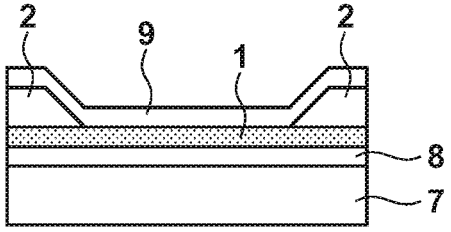

In the first to third resistance monitor elements, the shapes of the resistors 1, 3, and 5 are different. FIG. 3D shows a schematic section of each of the first to third resistance monitor elements. The first resistance monitor element will be described here as an example. The insulating layer 8, the resistor 1, and the electrodes 2 are stacked on the base 7 and patterned into shapes. The protective film 9 is stacked on them. The arrangement of the resistance monitor element is the same as the arrangement of the heater 27 shown in FIG. 1C, and they are formed simultaneously by the same process. Here, the first to third resistance monitor elements are preferably arranged at positions close to each other.

In addition, a driving circuit (not shown) configured to selectively drive the heaters is connected to the heaters to discharge droplets (ink). However, such a driving circuit is not connected to the resistance monitor elements. If a driving circuit or the like is connected to the resistance monitor elements, the variation in the resistance of the driving circuit or the like is also measured, resulting in difficulty in measuring the accurate resistance of the resistor.

Furthermore, to decrease the wiring resistance value from an electrode pad connected to the resistance monitor element, the set of the three resistance monitor elements is arranged at a position close to the electrode pads 24. The wiring resistance value of a wire from the electrode pad 24 connected to each resistance monitor element is configured to be equal between the resistance monitor elements and is made as small as possible. Accordingly, the variation in the wiring resistance value need not be taken into consideration when the resistance value of each resistance monitor element is measured. Additionally, to reduce the wiring resistance value from the electrode pad connected to the resistance monitor element, the following arrangement is employed. That is, when a distance (LPH) from the electrode pad 24 to the heater 27 with the shortest distance from the electrode pad 24 in the plurality of heaters 27 and a distance (LPT) from the electrode pad 24 to the resistance monitor element are compared, LPH>LPT holds. Furthermore, LPT is more preferably not more than ½ of LPH. Moreover, if the resistance monitor elements are arranged along the direction of the pad array in which the plurality of electrode pads 24 are arranged, the resistance values of the wirings from the electrode pads 24 connected to the resistance monitor elements can easily be made even.

In addition, the length or width of the resistor of at least one resistance monitor element in the three resistance monitor elements is preferably the same or almost the same as the length or width of the heater. Accordingly, the deviation of the size of the heater from the design value and the deviation of the size of the resistance monitor element from the design value become the same.

Figure 11:
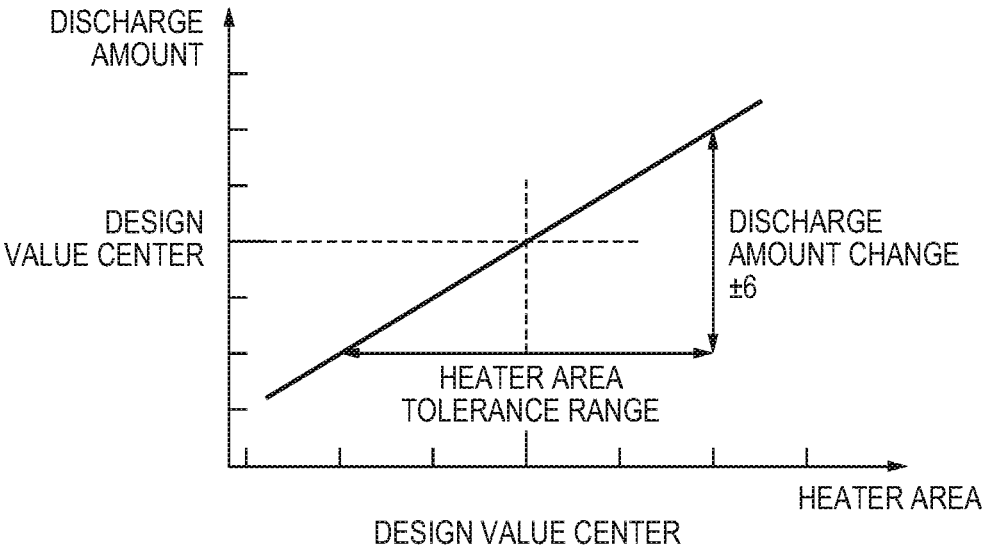
FIG. 11 is a graph showing the relationship between the area of a heater and a discharge amount.

The influence of the variation in the area of the heater will be described here with reference to FIG. 11. FIG. 11 is a graph representing the relationship between the area of the heater and the discharge amount of ink droplets. The ordinate represents the discharge amount, and the abscissa represents the area of the heater. Note that the area of the heater is the area of a portion of the heater 27 where a current flows, and in the arrangement shown in FIG. 1C, the area of the heater is the area of a portion of the heater 27 located between the pair of wiring electrodes 28 in a plan view of the print element substrate 21. When the area of the heater increases, the discharge amount increases, as is known. When the area of the heater changes, the area of a region where ink bubbles due to heat generation of the heater changes, and the size of bubbling of ink changes. As a result, the amount of discharged ink changes, and a change occurs in the amount of ink that arrives at a print medium. Here, if the area of the heater fluctuates within the tolerance range of the area of the heater, the change of the discharge amount appears as a change of ±6%.

In this relationship, if it is assumed that the factors such as the variation amount of the discharge amount that poses no problem in actual printing, the area variation of the heater, and the variation in the orifice diameter coincidentally occur, the variation permission amount of the discharge amount by the area variation of the heater is ±2%. Since the permission amount (±2%) is smaller than the variation amount (±6%) of the discharge amount within the tolerance range of the heater area, it is necessary to separately measure and screen the area of the heater and embed the heater in the head. Hence, as the characteristic feature of the present invention, the resistance value of the resistance monitor element formed at the same time by the same process as the heater is accurately measured, and the area of the heater is calculated.

(Manufacturing Method)

The manufacturing method of a heater and a resistance monitor element will be described next. A description will be made by comparing FIGS. 1C and 3D. The base 7 and the insulating layer 8 are common. The resistor 1 and the heater 27 are formed simultaneously by the same method using the same material, for example, TaSiN or the like. The electrodes 2 and the wiring electrodes 28 are formed simultaneously by the same method using the same material, for example, Al or the like. In the patterning of the layers, they are formed simultaneously by the same method. The protective film 9 is common and is formed simultaneously by the same method using, for example, SiN or the like. In this way, the heater and the resistance monitor element are formed simultaneously by the same method.

Figure 12A:
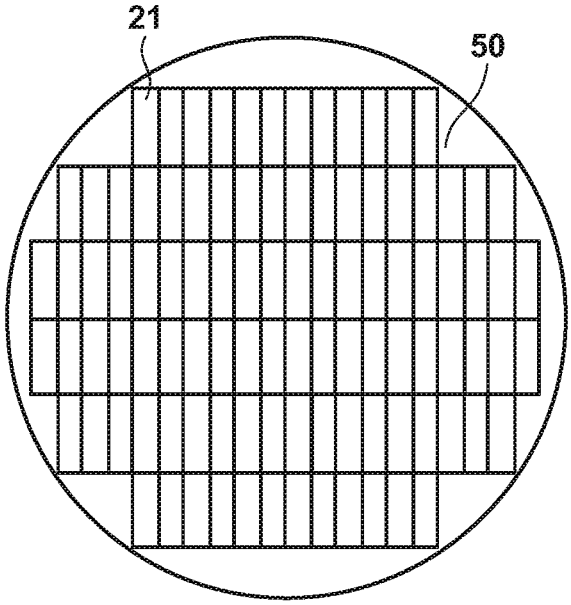
FIGS. 12A, 12B, and 12C are views for explaining a film thickness distribution in a wafer.
Figure 12B:
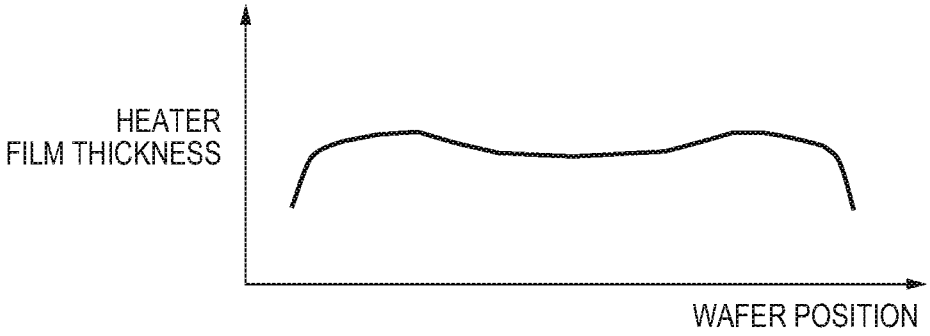
Figure 12C:
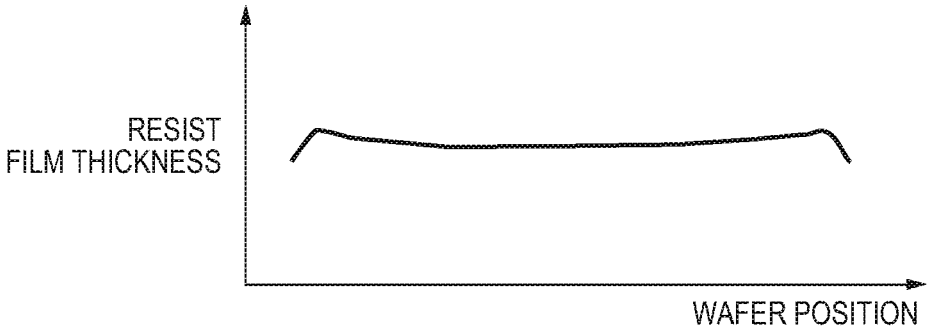

The product is formed on a wafer basis, as shown in FIGS. 12A to 12C. Referring to FIG. 12A, a plurality of print element substrates 21 are formed on a wafer 50. On the wafer 50, the film thickness distribution of the heaters is not completely even, and the heaters have a film thickness distribution as shown in FIG. 12B. For this reason, the film thickness tolerance is about ±15%. In addition, the distribution of resist film thicknesses in a patterning process is not completely even, and the resist films have a film thickness distribution as shown in FIG. 12C. For this reason, the tolerance of the film thickness of the resist is about ±10%. As for the quality, thickness, and patterning of the film of each material as well, process variations in the resist thickness, exposure time, development time, and the like simultaneously occur, and when forming a heater, the area of the heater may vary even in the same wafer. However, even in such a forming method, since the heater and the resistance monitor element are simultaneously formed, the heater and the resistance monitor element can be formed in the same deviation amount. In other words, if the deviation amount of the resistance monitor element from the design value is known, the deviation amount of the heater from the design value can be known, and the actual size of the heater can be known.

(Printhead)

Figure 4A:
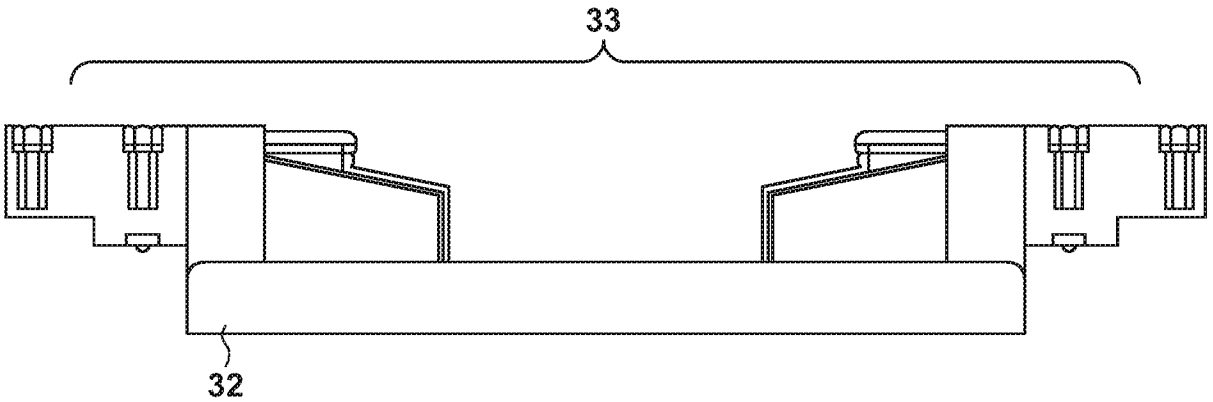
FIGS. 4A and 4B are views showing an example of the arrangement of a printhead according to the present invention.
Figure 4B:
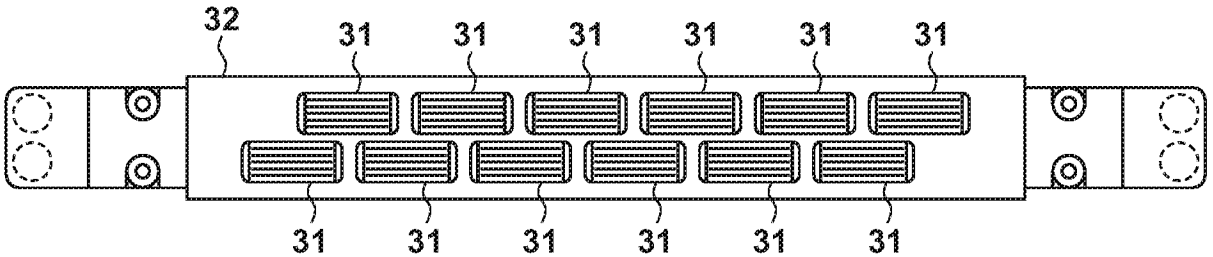

FIGS. 4A and 4B are views showing an example of the arrangement of a printhead according to the present invention. Referring to FIGS. 4A and 4B, a printhead 33 is a line type printhead in which inkjet nozzle arrays are formed within the range to cover the maximum width of a sheet assumed to be printed. The arranging direction of the nozzle arrays is a direction (second direction) crossing, for example, orthogonal to a direction (first direction) in which a sheet is conveyed in the printing apparatus. A plurality of print element substrates 31 with nozzles are arranged along the second direction on a large plate 32.

As shown in FIG. 4B, the plurality of (in this example, 12) print element substrates 31 with nozzles having the same dimensions and the same structure are formed over the whole region in the widthwise direction periodically as two lines in a staggered arrangement. That is, in the printhead 33, a plurality of first print element substrates with nozzles and a plurality of second print element substrates with nozzles, each of which includes a nozzle array, are arranged as different arrays in the second direction. A first print element substrate with nozzles and a second print element substrate with nozzles, which are adjacent to each other, have a positional relationship shifted in the second direction. In the first print element substrate with nozzles and the second print element substrate with nozzles, which are adjacent to each other, some of the nozzle arrays included in them overlap in the second direction.

(Printing Apparatus)

Figure 5:
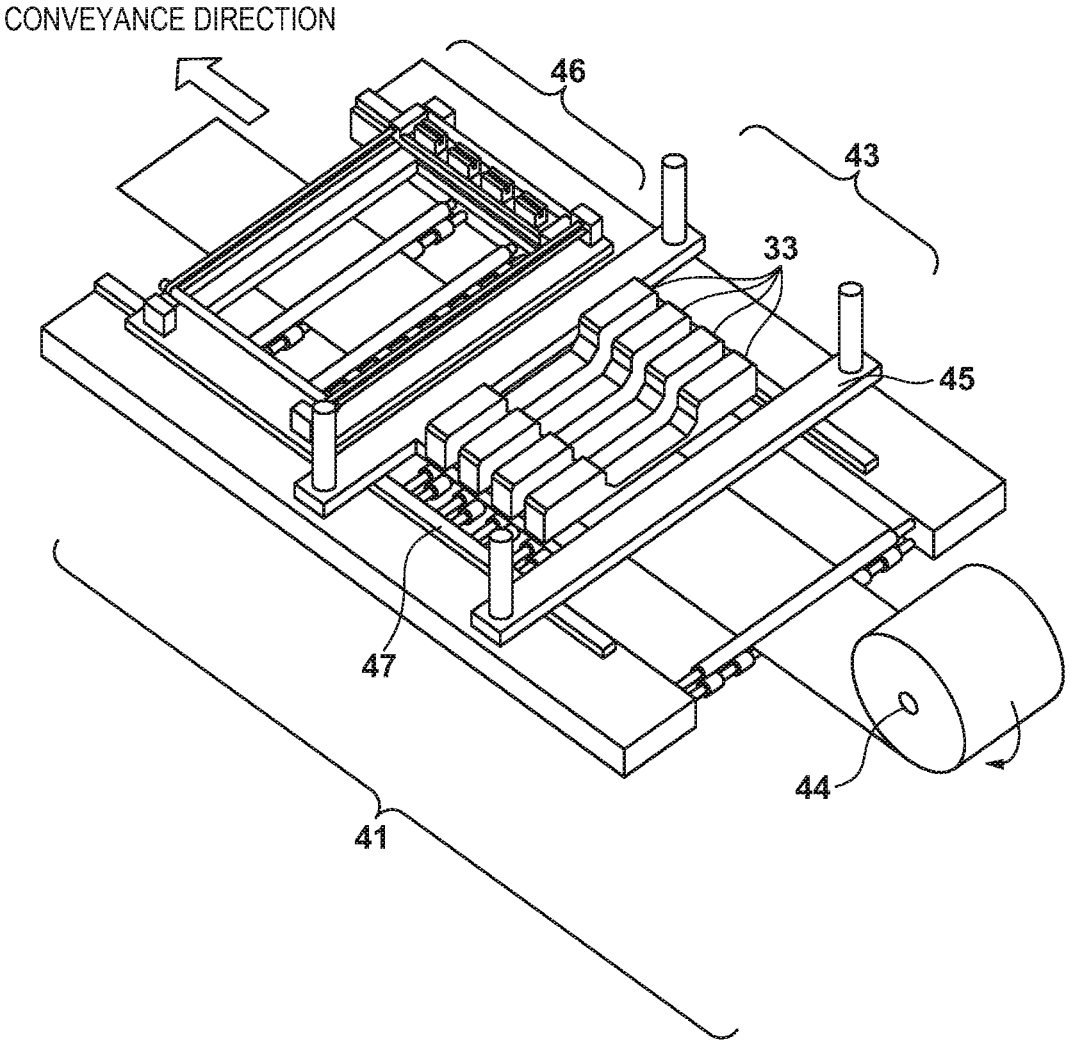
FIG. 5 is a view showing an example of the arrangement of a printing apparatus according to the present invention.

FIG. 5 is a view showing an example of the arrangement of a printing apparatus according to the present invention. Referring to FIG. 5, a printing apparatus 41 is a line printer that performs printing using a long line head (printhead 33) while continuously conveying a sheet in the conveyance direction (first direction). The printing apparatus 41 includes a holder that holds a sheet 44 such as a continuous sheet wound in a roll shape, a conveyance mechanism 47 that conveys the sheet 44 in the first direction at a predetermined speed, and a printing unit 43 that performs printing on the sheet 44 by the line head. Note that the sheet is not limited to the continuous roll sheet and may be a cut sheet.

The printing apparatus 41 further includes a cleaning unit 46 that cleans the nozzle surface of the printhead 33 by wiping. The printing apparatus 41 also includes a cutter unit (not shown) that cuts the sheet 44, a drying unit (not shown) that forcibly dries the sheet 44, and a discharge tray (not shown) along the sheet conveyance path on the downstream side of the printing unit 43. The printing unit 43 includes a plurality of printheads 33 corresponding to different ink colors. In this example, four printheads corresponding to four colors of C, M, Y, and K are used. However, the number of colors is not limited to this. The ink of each color is supplied for an ink tank to the printhead 33 via an ink tube. The plurality of printheads 33 are integrally held by a head holder 45, and the head holder 45 has a function of vertically moving so as to change the distances between the plurality of printheads 33 and the surface of the sheet 44.

First Embodiment

A case in which the three types of resistance monitor elements shown in FIGS. 3A to 3D are used will be described. Note that the number of resistance monitor elements is merely an example and is not limited to this number.

FIG. 3A shows a resistor 1 as a first resistance monitor element and electrodes 2 connected to this. The width of the resistor 1 is represented by WT1+ΔW, and the length is represented by LT1+ΔL. WT1 and LT1 are the design value of the width and the design value of the length of the first resistance monitor element. In addition, ΔW and ΔL are the deviation amount of the width and the deviation amount of the length of the resistor from the design values at the time of formation. The sheet resistance value of the resistor 1 is ρs, and the resistance value of the first resistance monitor element is R1. Note that the width of the resistor 1 is the length of the resistor 1 in the direction orthogonal to the direction in which a current flows in the resistor 1 in a plan view, and the length of the resistor 1 is the length of the resistor 1 in the direction in which a current flows in the resistor 1 in a plan view. Note that the length and width of the resistor 1 is the length and width in a portion of the resistor 1 to which a current flows via the electrode 2. This also applies to the resistors of other resistance monitor elements and the heater.

FIG. 3B shows a resistor 3 as a second resistance monitor element and electrodes 4 connected to this. The width of the resistor 3 is represented by WT2+ΔW, and the length is represented by LT2+ΔL. WT2 and LT2 are the design value of the width and the design value of the length of the second resistance monitor element. In addition, ΔW and ΔL are the deviation amount of the width and the deviation amount of the length of the resistor from the design values at the time of formation. The sheet resistance value of the resistor 3 is ρs, and the resistance value of the second resistance monitor element is R2.

FIG. 3C shows a resistor 5 as a third resistance monitor element and electrodes 6 connected to this. The width of the resistor 5 is represented by WT3+ΔW, and the length is represented by LT3+ΔL. WT3 and LT3 are the design value of the width and the design value of the length of the third resistance monitor element. In addition, ΔW and ΔL are the deviation amount of the width and the deviation amount of the length of the resistor from the design values at the time of formation. The sheet resistance value of the resistor 5 is ρs, and the resistance value of the third resistance monitor element is R3.

As described above, since the first to third resistance monitor elements are arranged at the positions close to each other, ΔW and ΔL which are the deviation amounts from the design values of the resistance monitor elements are almost the same in the resistance monitor elements. Additionally, since the heaters and the resistance monitor elements are formed simultaneously by the same process, ΔW and ΔL which are the deviation amounts from the design values are almost the same in the heaters and the resistance monitor elements.

A method of calculating the area of a heater will be described next.

For the first resistance monitor element, a relation represented by $$R1 = \frac{(LT1 + \Delta L)}{(WT1 + \Delta W)} \times \rho s \tag{1}$$

holds.

For the second resistance monitor element, a relation represented by $$R2 = \frac{(LT2 + \Delta L)}{(WT2 + \Delta W)} \times \rho s \tag{2}$$

holds.

For the third resistance monitor element, a relation represented by $$R3 = \frac{(LT3 + \Delta L)}{(WT3 + \Delta W)} \times \rho s \tag{3}$$

holds.

In equations (1), (2), and (3), LT1, WT1, LT2, WT2, LT3, and WT3 which are the design values of the resistance monitor elements are known values. In addition, the resistance values R1, R2, and R3 of the resistance monitor elements are obtained by electrically measuring them. Hence, three values, that is, the deviation amount ΔW of the width, the deviation amount ΔL of the length, and ρs that is the sheet resistance value of the resistor are handled as variables. For this reason, the three variables can be calculated by solving ternary simultaneous equations by the three equations. Hence, ΔW and ΔL which are the deviation amounts from the design values are obtained.

Hence, when the deviation amount ΔW of the width is added to the design value of the width of the heater, the dimension of the width of the actual heater is obtained. In addition, when the deviation amount ΔL of the length is added to the design value of the length of the heater, the dimension of the length of the actual heater is obtained. Then, when the dimension of the width of the actual heater is multiplied by the dimension of the length of the actual heater, the area of the actual heater can be calculated.

The shapes of the three resistance monitor elements will be described. In the relationship of the three resistance monitor elements, it is impossible to arrange resistance monitor elements having the same shape, that is, resistance monitor elements for which all of the lengths and widths are equal. When resistance monitor elements having the same shape are used, two of three equations (1), (2), and (3) described above are identical. For this reason, the three variables are obtained by two equations, and it is impossible to derive the values. In addition, it is also impossible to use resistance monitor elements of a square shape as all the three resistance monitor elements. In equations (1), (2), and (3) described above, if three square resistance monitor elements are used, when ΔL and ΔW are the same value, the variation in the resistance value is eliminated if the designed shape of the resistance monitor elements is square. For this reason, the resistance values R1, R2, and R3 become equal in the three equations, and the ternary simultaneous equations cannot be solved. Furthermore, it is also impossible to use the same dimensions as the widths and lengths of all the three resistance monitor elements. The ternary simultaneous equations cannot be solved in this case as well.

Here, the resistance values R1, R2, and R3 of the first to third resistance monitor elements are preferably made equal (same or almost same) as much as possible. When measuring an extremely different resistance value, the measurement range or the like may change depending on the measurement value in terms of the measuring device or the like, and an error generation amount may change depending on the resistance value. Hence, when the resistance values are made equal in the resistance monitor elements, the variation in measurement can be suppressed to a predetermined range, and the deviation amount $\Delta W$ of the width and the deviation amount $\Delta L$ of the length obtained by the calculation can accurately be detected.

Note that in this embodiment, three resistance monitor elements are used, three simultaneously equations corresponding to the resistance monitor elements are defined, and the deviation amounts are calculated. In regard to this, if variables that can cause deviation amounts can be obtained, an arrangement using more resistance monitor elements may be employed. In addition, if one of the deviation amount of the width and the deviation amount of the length is small, and the one of the deviation amounts can be neglected, two resistance monitor elements of the three resistance monitor elements described above are provided.

(Calculation of Areas of Heaters)

An outline of a process of calculating the areas of the heaters according to the present invention will be described next with reference to FIG. 6.

In step S601, the resistance values of three resistance monitor elements are measured.

In step S602, the areas of the heaters are calculated by calculation based on the measured resistance values.

In step S603, the areas of the heaters are ranked based on the calculated areas. That is, in the ranking here, the print element substrates are classified into a plurality of ranks based on the range to a preset area of a heater.

The processes of steps S601 to S603 are also called a heater area ranking process (S600) as a whole.

(Formation of Printhead)

The outline of a process of forming a printhead will be described with reference to FIGS. 7A, 7B, and 7C. Here, three patterns are shown as the procedures of printhead formation. In the patterns, the timing of performing the heater area ranking process (S600) changes.

Figure 7A:
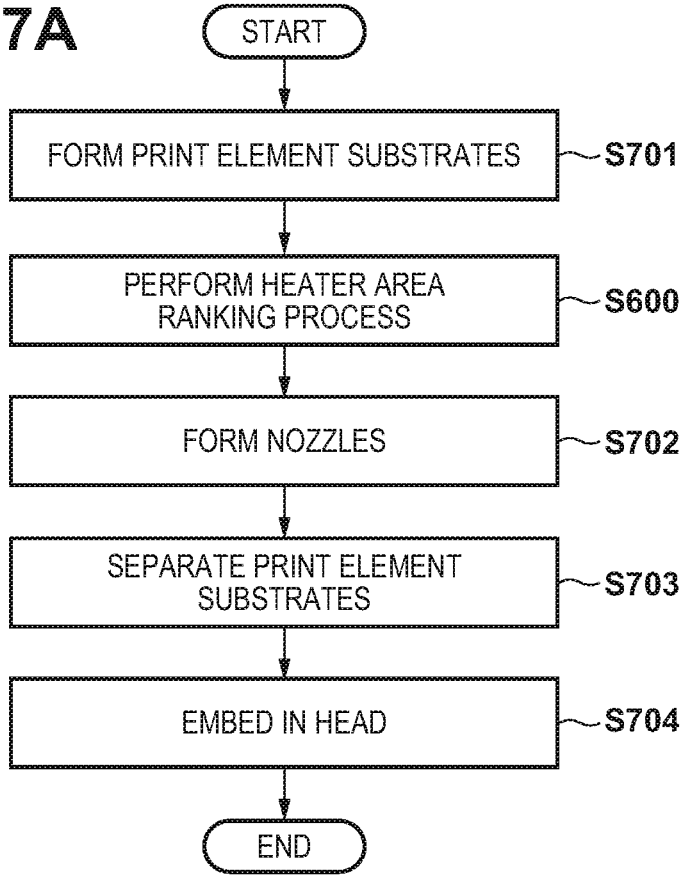
FIGS. 7A, 7B, and 7C are flowcharts of formation of the printhead according to the present invention.

In FIG. 7A, the heater area ranking process is performed on a wafer basis after print element substrate formation.

First, in step S701, a plurality of print element substrates and three resistance monitor elements are formed on a wafer.

Figure 6:
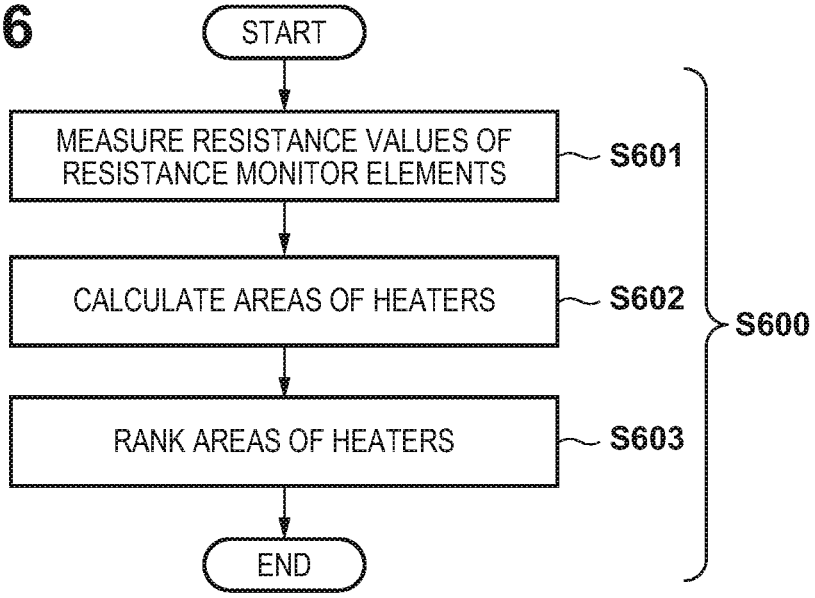
FIG. 6 is a flowchart used to calculate the area of a heater according to the present invention.

Next, the heater area ranking process (S600) described with reference to FIG. 6 is performed.

Next, in step S702, nozzles corresponding to the plurality of print element substrates are formed in the form of the wafer.

Then, in step S703, the plurality of print element substrates with nozzles on the wafer are separated.

After that, in step S704, the separated print element substrates with nozzles are embedded in a printhead based on the ranking by the heater area ranking process (S600). That is, a plurality of print element substrates including heaters classified into the same rank are embedded in one printhead so as not to cause density unevenness in the printhead.

Figure 7B:
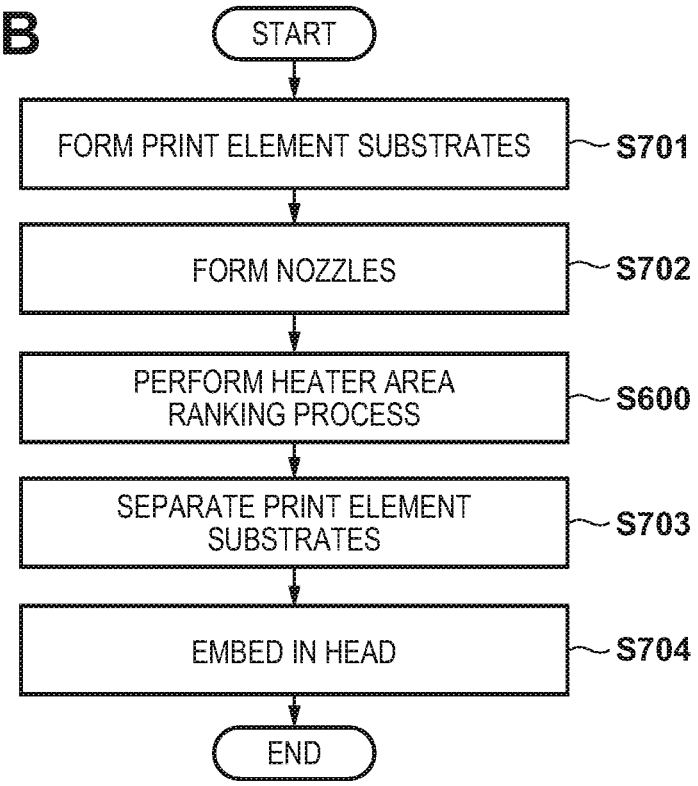

In FIG. 7B, the heater area ranking process is performed on a wafer basis after nozzle formation. The same processes as those shown in FIG. 7A are denoted by common step numbers.

First, in step S701, a plurality of print element substrates and three resistance monitor elements are formed on a wafer.

Next, in step S702, nozzles corresponding to the plurality of print element substrates are formed in the form of the wafer.

Next, the heater area ranking process (S600) described with reference to FIG. 6 is performed.

Then, in step S703, the plurality of print element substrates with nozzles on the wafer are separated.

After that, in step S704, the separated print element substrates with nozzles are embedded in a printhead based on the ranking by the heater area ranking process (S600).

Figure 7C:
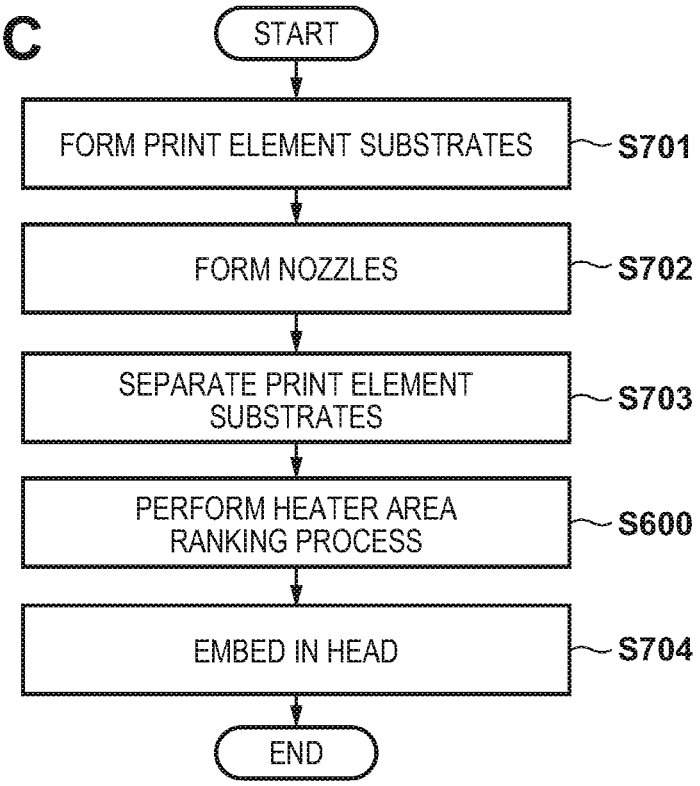

In FIG. 7C, after a plurality of print element substrates with nozzles on a wafer are separated, the heater area ranking process is performed on a print element substrate basis.

First, in step S701, a plurality of print element substrates and three resistance monitor elements are formed on a wafer.

Next, in step S702, nozzles corresponding to the plurality of print element substrates are formed in the form of the wafer.

Next, in step S703, the plurality of print element substrates with nozzles on the wafer are separated.

Then, the heater area ranking process (S600) described with reference to FIG. 6 is performed.

After that, in step S704, the separated print element substrates with nozzles are embedded in a printhead based on the ranking by the heater area ranking process (S600).

Second Embodiment

FIGS. 8A, 8B, 8C, and 8D are views showing examples of the arrangements of resistance monitor elements according to the second embodiment of the present invention. This is an example of a case in which the layers of the resistance elements are made flat using a planarization technique.

Figure 8A:
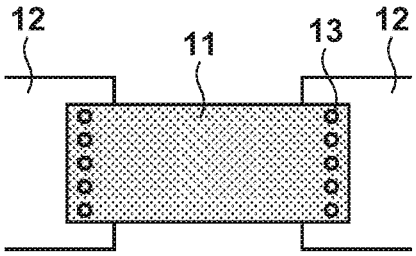
FIGS. 8A, 8B, 8C, and 8D are views showing examples of resistance monitor elements according to the second embodiment.
Figure 8B:
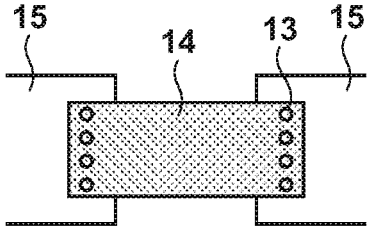
Figure 8C:
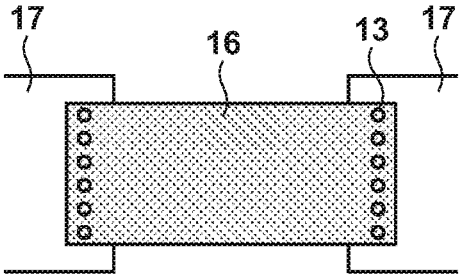

FIG. 8A shows a resistor 11 serving as a first resistance monitor element, electrodes 12, and a plurality of vias 13 that electrically connect the resistor 11 and the electrodes 12. FIG. 8B shows a resistor 14 serving as a second resistance monitor element, electrodes 15, and the vias 13 that electrically connect the resistor 14 and the electrodes 15. FIG. 8C shows a resistor 16 serving as a third resistance monitor element, electrodes 17, and the vias 13 that electrically connect the resistor 16 and the electrodes 17. Note that in the resistance monitor element according to this embodiment, since a current flows to a portion of the resistor located between the plurality of pairs of vias 13, the resistance value of the resistance monitor element is determined by the length and width of this portion.

Figure 8D:
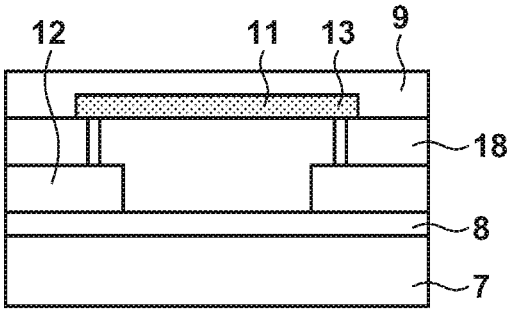

The manufacturing method of each resistance monitor element will be described with reference to FIG. 8D. SiO is stacked as an insulating layer 8 on Si as a base 7. Al is deposited as the electrodes 12 and etched into a predetermined pattern to form the electrodes 12. Next, SiO is deposited as an interlayer dielectric film 18, and the interlayer dielectric film 18 is planarized using the CMP technology or the like. After that, through holes are formed in the interlayer dielectric film 18 at positions to form the vias 13 used for electrical connection. W as the vias 13 is deposited to fill the portions of the vias 13. Planarization is performed using the CMP technology or the like to complete the vias 13. TaSiN or the like is deposited as a resistance layer and etched into a predetermined pattern to form the resistor 11. After that, SiN is deposited as a protective film 9, and the resistance monitor element is completed.

Here, a heater configured to cause discharge of ink droplets is also formed into the same arrangement simultaneously by the same process. That is, the heater also has the arrangement in the form as shown in FIGS. 8A to 8D in which the heater and electrodes are connected via the vias, like the resistance monitor elements.

As described above, even if the heater or the resistance element is formed using the planarization technique, the area of the actual heater can be calculated as in the first embodiment.

A simple arrangement has been described here. In fact, a diffusion preventing film or the like can be arranged as needed on the surface of the metal material of the electrodes 12 or the vias 13.

Even in the arrangement according to this embodiment, the same effect as in the first embodiment can be obtained.

Third Embodiment

Figure 9A:
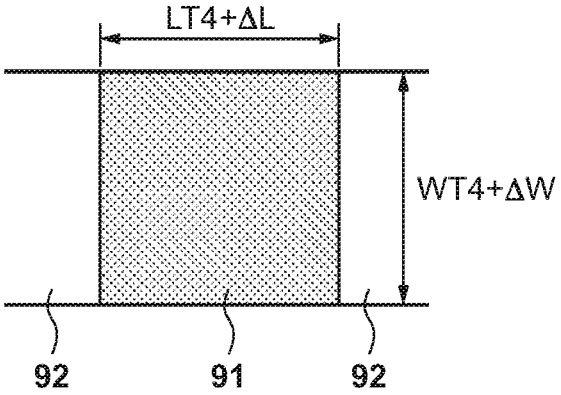
FIGS. 9A, 9B, and 9C are views showing examples of resistance monitor elements according to the third embodiment.
Figure 9B:
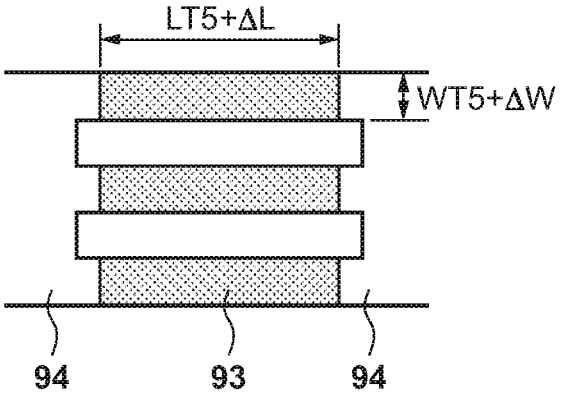
Figure 9C:
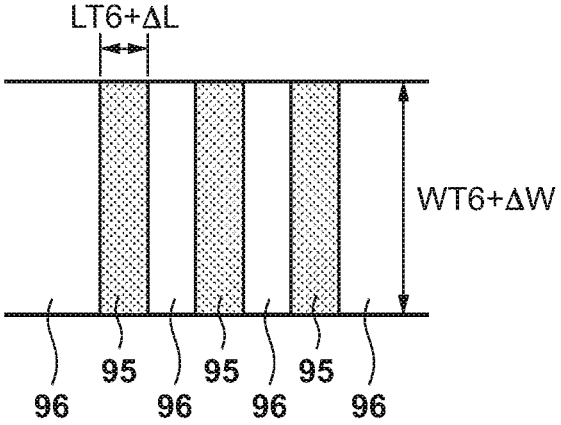

FIGS. 9A, 9B, and 9C are views showing examples of the arrangements of resistance monitor elements according to the third embodiment of the present invention. This is an example of a case in which the connection method for the resistors of the resistance monitor elements is changed.

FIG. 9A shows a resistor 91 serving as a first resistance monitor element, and electrodes 92 connected to the resistor 91. The width of the resistor 91 is represented by WT4+ΔW, and the length is represented by LT4+ΔL. WT4 and LT4 are the design value of the width and the design value of the length of the first resistance monitor element. In addition, ΔW and ΔL are the deviation amount of the width and the deviation amount of the length of the resistor from the design values at the time of formation. The sheet resistance value of the resistor 91 is ρs, and the resistance value of the first resistance monitor element is R4.

FIG. 9B shows resistors 93 serving as second resistance monitor elements, and electrodes 94 connected to the resistors 93. Three resistors 93 are electrically connected in parallel with the electrodes 94. The width of the resistor 93 is represented by WT5+ΔW, and the length is represented by LT5+ΔL. WT5 and LT5 are the design value of the width and the design value of the length of the second resistance monitor element. In addition, ΔW and ΔL are the deviation amount of the width and the deviation amount of the length of the resistor from the design values at the time of formation. The sheet resistance value of the resistor 93 is ρs, and the resistance value of the second resistance monitor element is R5.

FIG. 9C shows three resistors 95 serving as third resistance monitor elements, and electrodes 96 connected to the resistors 95. The three resistors 95 are electrically connected in series with the electrodes 96. The width of the resistor 95 is represented by WT6+ΔW, and the length is represented by LT6+ΔL. WT6 and LT6 are the design value of the width and the design value of the length of the third resistance monitor element. In addition, ΔW and ΔL are the deviation amount of the width and the deviation amount of the length of the resistor from the design values at the time of formation. The sheet resistance value of the resistor 95 is ρs, and the resistance value of the third resistance monitor element is R6.

A method of calculating the area of a heater will be described next.

For the first resistance monitor element, a relation represented by $$R4 = \frac{(LT4 + \Delta L)}{(WT4 + \Delta W)} \times \rho s \tag{4}$$

holds.

For the second resistance monitor element, a relation represented by $$R5 = \frac{(LT5 + \Delta L)}{n \times (WT5 + \Delta W)} \times \rho s \tag{5}$$

holds, where n is the number of resistors 93 connected in parallel, and n=3 here.

For the third resistance monitor element, a relation represented by $$R6 = \frac{n \times (LT6 + \Delta L)}{(WT6 + \Delta W)} \times \rho s \tag{6}$$

holds, where n is the number of resistors 95 connected in series, and n=3 here.

In equations (4), (5), and (6), LT4, WT4, LT5, WT5, LT6, and WT6 which are the design values of the resistance monitor elements are known values. In addition, n is the number of connected resistors and is also a known value. The resistance values R4, R5, and R6 of the resistance monitor elements are obtained by electrically measuring them. Hence, three values, that is, the deviation amount ΔW of the width, the deviation amount ΔL of the length, and ρs that is the sheet resistance value of the resistor are handled as variables. For this reason, the three variables can be calculated by solving ternary simultaneous equations by the three equations. ΔW and ΔL which are the deviation amounts from the design values are thus obtained.

In FIGS. 9B and 9C, three resistors are connected in parallel or in series with the electrodes. However, the number of resistors need not always be three, and connecting a plurality of resistors in parallel or in series suffices. As described above, when the number of resistors connected in series in the third resistance monitor element is n, ΔL influences as an n-times change amount on the resistance value in equation (6), and a change in ΔL can easily be detected. Here, if the resistors are simply connected in series in the resistance monitor element, the absolute value of the resistance value of the first resistance monitor element becomes large, and a measurement variation that occurs when measuring the resistance may change between the resistance monitor elements. At this time, the variation in ΔL obtained by calculation increases. Hence, it is preferable to reduce the length of each of the resistors connected in series to lower the resistance value such that the absolute values of the resistance values are made close between the other resistance monitor elements by the total resistance value of the resistors connected in series.

Similarly, it is preferable to narrow the width of each of the resistors connected in parallel to raise the resistance value such that the absolute values of the resistance values are made close between the other resistance monitor elements by the total resistance value of the resistors connected in parallel. Furthermore, when the length of each of such resistors connected in series is decreased, the change ratio of the resistance value that changes by ΔL can be made large.

An arrangement in which one of the three resistance monitor elements has resistors arranged in series, and another resistance monitor element has resistors arranged in parallel has been described. However, the present invention is not limited to this. Of the three resistance monitor elements, the number of resistance monitor elements in which the resistors are arranged in series may be three, two, one, or zero. In addition, of the three resistance monitor elements, the number of resistance monitor elements in which the resistors are arranged in parallel may be three, two, one, or zero.

Even in the arrangement according to this embodiment, the same effect as in the first embodiment can be obtained.

Fourth Embodiment

Figure 10:
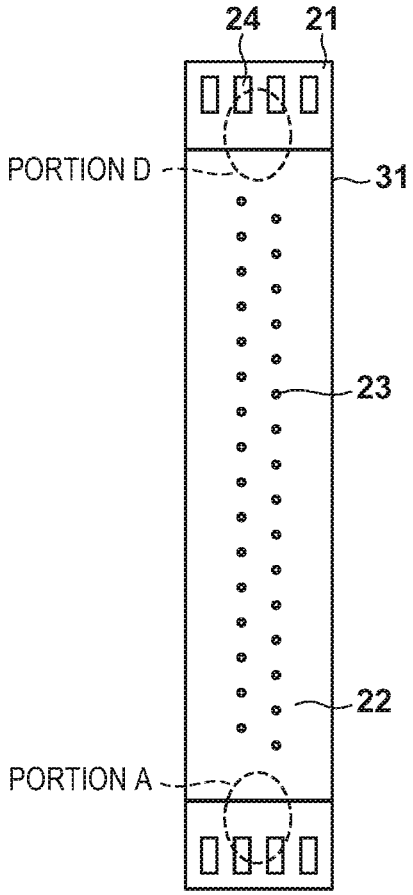
FIG. 10 is a view showing an example of the arrangement of resistance monitor elements according to the fourth embodiment.

FIG. 10 is a view showing an example of the arrangement of resistance monitor elements according to the fourth embodiment of the present invention. If a print element substrate becomes large, and the size of a heater changes in the print element substrate, a plurality of sets each including three resistance monitor elements can be arranged.

Referring to FIG. 10, in a print element substrate 31 with nozzles, a through hole (not shown) configured to supply ink from the back surface of the print element substrate is formed. A plurality of heaters (not shown) configured to apply discharge energy to the ink are arranged on the surface of a print element substrate 21. In addition, an orifice plate 22 is provided on the print element substrate 21, and a plurality of orifices 23 are formed in the orifice plate 22 so as to face the plurality of heaters, respectively. A plurality of electrode pads 24 electrically connected to the plurality of heaters or the like are arranged at two ends of the surface of the print element substrate 21.

A set including three resistance monitor elements according to the present invention is arranged in each of two portions A and D in FIG. 10. The three resistance monitor elements are arranged at positions close to each other and are also arranged at positions close to the electrode pads 24 arranged at the substrate ends. Wirings configured to measure the resistances of the resistance monitor elements are connected to the electrode pads 24 and configured such that the measurement can be performed from the outside.

With this arrangement, even if the print element substrate becomes large, density unevenness between the print element substrates can be suppressed, and satisfactory printing can be performed.

Fifth Embodiment

Figure 13A:
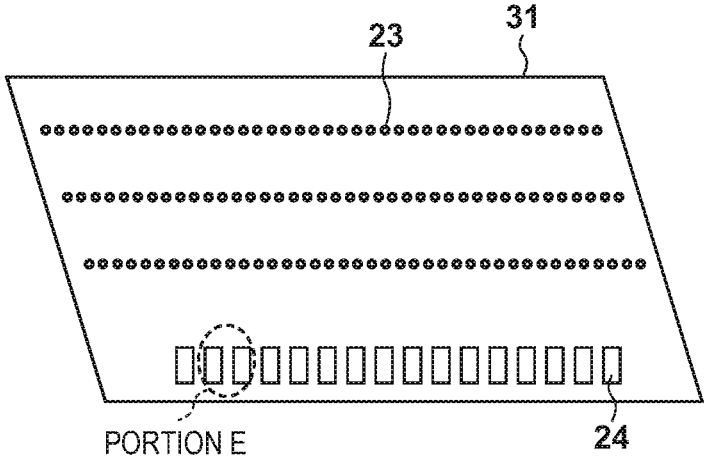
FIGS. 13A, 13B, and 13C are views showing an example of a print element substrate according to the fifth embodiment and a part thereof.
Figure 13B:
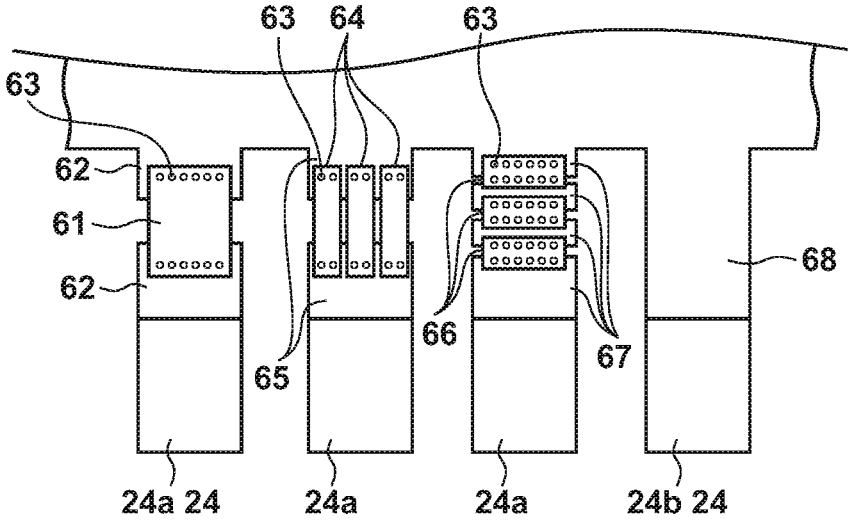
Figure 13C:
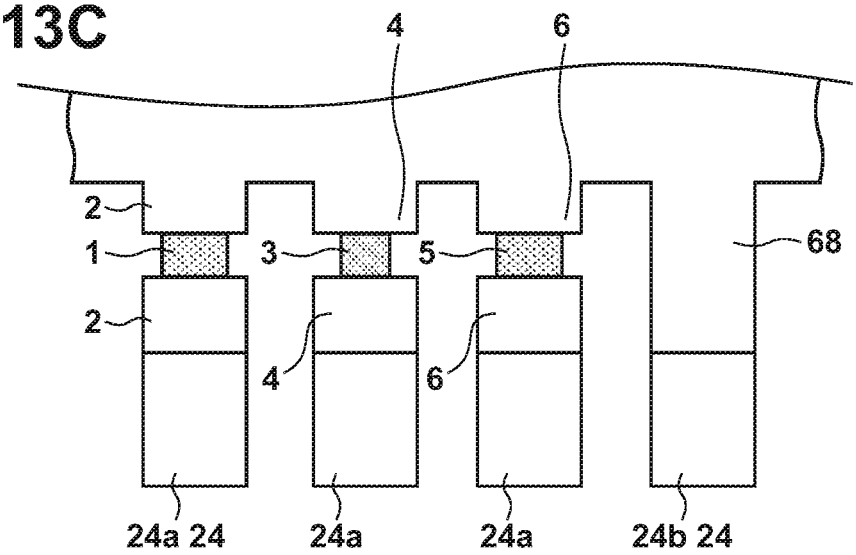

FIGS. 13A, 13B, and 13C are views showing a print element substrate 31 with nozzles according to the fifth embodiment of the present invention and a part thereof. As shown in FIG. 13A, the print element substrate 31 with nozzles has a parallelogrammatic shape in which the angle made by sides adjacent to each other is not a right angle. Although not illustrated in FIG. 13A, heaters 27 are arranged in correspondence with orifices 23, respectively. In addition, a plurality of electrode pads 24 are arranged along the arranging direction of the orifices 23 (the arranging direction of the heaters 27). Three resistance monitor elements according to the present invention are arranged in a portion E shown in FIG. 13A. That is, in a plan view of the print element substrate, the plurality of resistance monitor elements are arranged such that they are sandwiched between the array of the electrode pads 24 and a heater array formed by arranging the heaters. FIGS. 13B and 13C are enlarged views of the portion E in FIG. 13A.

An example shown in FIG. 13B will be described. In this example, the second embodiment and the third embodiment are combined. That is, a resistor 61 serving as a first resistance monitor element and electrodes 62 are electrically connected via a plurality of vias 63. In addition, three resistors 64 serving as a second resistance monitor element and electrodes 65 are electrically connected via the plurality of vias 63. Note that the three resistors 64 are electrically connected in parallel with the electrodes 65. Furthermore, three resistors 66 serving as a third resistance monitor element and electrodes 67 are electrically connected via the plurality of vias 63. The three resistors 66 are electrically connected in parallel with the electrodes 67. In addition, one of the electrodes connected to each of the first to third resistance monitor elements is connected to an electrode pad 24*a* provided in correspondence with each monitor element. Furthermore, the other of the electrodes connected to each of the first to third resistance monitor elements is connected to a common electrode pad 24*b* via a common electrode 68 to which the electrodes are commonly connected. This can decrease the number of electrode pads.

Note that as shown in FIG. 13C, in an arrangement as in the first embodiment, the other of the electrodes connected to each of the first to third resistance monitor elements as shown in FIG. 13B may be connected to the common electrode pad 24*b* via the common electrode 68.

Embodiment(s) of the present invention can also be realized by a computer of a system or apparatus that reads out and executes computer executable instructions (e.g., one or more programs) recorded on a storage medium (which may also be referred to more fully as 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-127830, filed Jun. 29, 2017, and Japanese Patent Application No. 2018-088406, filed May 1, 2018, which are hereby incorporated by reference herein in their entirety.

What is claimed is:

1. A print element substrate comprising:

a plurality of heaters configured to cause discharge of droplets;

a pad array in which a plurality of pads configured to do electrical connection from an outside are arranged; and a plurality of resistance monitor elements configured to measure resistance values of the plurality of heaters, wherein the plurality of resistance monitor elements are arranged along a direction of the pad array, and wherein a distance between the pad array and each of the plurality of resistance monitor elements is shorter than a distance between the pad array and a heater having a shortest distance from the pad array in the plurality of heaters.

2. The substrate according to claim 1, wherein a distance between the pad array and each of the plurality of resistance monitor elements is not more than ½ of a distance between the pad array and a heater having a shortest distance from the pad array in the plurality of heaters.

3. The substrate according to claim 1, further comprising a driving circuit connected to the heaters and configured to drive the heaters, wherein each of the plurality of resistance monitor elements is not connected to the driving circuit but connected to the pad.

4. The substrate according to claim 1, wherein the resistance monitor elements comprise at least three resistance monitor elements, and the at least three resistance monitor elements are configured to have different shapes.

5. The substrate according to claim 1, wherein the resistance monitor elements comprise at least three resistance monitor elements, and the at least three resistance monitor elements are configured to have shapes different from a square.

6. A print element substrate comprising:

a plurality of heaters configured to cause discharge of droplets;

a pad array in which a plurality of pads configured to do electrical connection from an outside are arranged; and a plurality of resistance monitor elements configured to measure resistance values of the plurality of heaters, wherein the plurality of resistance monitor elements are arranged along a direction of the pad array, and wherein wiring resistances between the plurality of resistance monitor elements and the pads are configured to be equal.

7. The substrate according to claim 1, wherein the resistance monitor elements comprise at least three resistance monitor elements, and each of the at least three resistance monitor elements is configured to have a width or a length different from widths or lengths of remaining resistance monitor elements.

8. The substrate according to claim 1, wherein in at least one resistance monitor element of the plurality of resistance monitor elements, a plurality of resistors are connected in series.

9. The substrate according to claim 1, wherein in at least one resistance monitor element of the plurality of resistance monitor elements, a plurality of resistors are connected in parallel.

10. The substrate according to claim 1, wherein the resistance monitor elements comprise at least three resistance monitor elements, and at least one resistance monitor element of the at least three resistance monitor elements and the heaters have the same or substantially same length or width.

11. The substrate according to claim 1, wherein a plurality of sets of the plurality of resistance monitor elements are provided on the print element substrate.

12. The substrate according to claim 1, wherein the heaters and the plurality of resistance monitor elements are formed using the same material.

13. A print element substrate comprising:

a plurality of heaters configured to cause discharge of droplets;

a pad array in which a plurality of pads configured to do electrical connection from an outside are arranged; and a plurality of resistance monitor elements configured to measure resistance values of the plurality of heaters, wherein the heaters are connected to electrodes via vias and the resistance monitor elements are connected to electrodes via other vias.

14. The substrate according to claim 1, further comprising a heater array formed by arranging the plurality of heaters along the direction of the pad array, and in a plan view of the print element substrate, the plurality of resistance monitor elements are arranged while being sandwiched between the pad array and the heater array.

15. A method of manufacturing a print element substrate including:

a plurality of heaters configured to cause discharge of droplets;

a pad array in which a plurality of pads configured to do electrical connection from an outside are arranged; and a plurality of resistance monitor elements configured to measure resistance values of the plurality of heaters, the method comprising forming the plurality of heaters and the plurality of resistance monitor elements using the same material, wherein the plurality of resistance monitor elements are arranged along a direction of the pad array, and wherein a distance between the pad array and each of the plurality of resistance monitor elements is shorter than a distance between the pad array and a heater having a shortest distance from the pad array in the plurality of heaters.

16. A method of manufacturing a printhead including a plurality of print element substrates, comprising:

forming, on one wafer, a plurality of print element substrates each including a plurality of heaters configured to cause discharge of droplets, a pad array in which a plurality of pads configured to do electrical connection from an outside are arranged, and a plurality of resistance monitor elements configured to measure resistance values of the plurality of heaters, wherein the plurality of resistance monitor elements are arranged along a direction of the pad array;

measuring a resistance value of each of the plurality of resistance monitor elements provided on each of the plurality of print element substrates;

calculating sizes of the heaters provided on each of the plurality of print element substrates based on the measured resistance values;

classifying the plurality of print element substrates based on the calculated sizes of the heaters; and embedding the plurality of print element substrates in one printhead based on the classification.

17. The method according to claim 16, wherein in the embedding, print element substrates classified into the same rank are embedded in the same printhead.

18. The substrate according to claim 13, further comprising a base to which the heaters, the resistance monitor elements, and the electrodes are constructed, and wherein the vias contacts with a surface of the heaters facing the base and extends toward the base, and wherein the other vias contacts with a surface of the resistance monitor elements facing the base and extends toward the base.

19. The substrate according to claim 13, wherein the resistance monitor elements and the pads are electrically connected via the other vias and the electrodes.

* * * * *